US005451466A

United States Patent [19]

Malhotra

[11] Patent Number: 5,451,466

[45] Date of Patent: Sep. 19, 1995

[54] RECORDING SHEETS

[75] Inventor: Shadi L. Malhotra, Mississauga, Canada

[73] Assignee: Xerox Corporation, Stamford, Conn.

[21] Appl. No.: 196,927

[22] Filed: Feb. 15, 1994

Related U.S. Application Data

[63] Continuation-in-part of Ser. No. 33,932, Mar. 19, 1993, Pat. No. 5,302,439.

[51] Int. Cl.[6] ..... B41M 5/00

[52] U.S. Cl. ..... 428/500; 428/195; 428/411.1

[58] Field of Search ..... 428/304, 514, 195, 411.1, 428/500

[56] References Cited

U.S. PATENT DOCUMENTS

| | | | |
|---|---|---|---|
| 3,488,189 | 1/1970 | Mayer et al. | 96/1.5 |
| 3,493,412 | 2/1970 | Johnson et al. | 117/17.5 |
| 3,561,337 | 2/1971 | Mulkey | 95/1 |
| 3,619,279 | 11/1971 | Johnston et al. | 117/155 |
| 3,946,129 | 3/1976 | Jones | 428/304 |
| 4,526,847 | 7/1985 | Walker et al. | 430/18 |
| 4,956,225 | 9/1990 | Malhotra | 428/216 |
| 4,997,697 | 3/1991 | Malhotra | 428/195 |
| 5,118,570 | 6/1992 | Malhotra | 428/474.4 |
| 5,145,749 | 9/1992 | Matthew | 428/511 |
| 5,202,205 | 4/1993 | Malhotra | 430/17 |
| 5,244,714 | 9/1993 | Malhotra et al. | 428/195 |

*Primary Examiner*—Pamela R. Schwartz
*Attorney, Agent, or Firm*—Judith L. Byorick

[57] ABSTRACT

Disclosed is a recording sheet which comprises (a) a substrate; (b) a coating on the substrate which comprises (i) a binder selected from the group consisting of (A) copolymers of styrene and at least one other monomer; (B) copolymers of acrylic monomers and at least one other monomer; and (C) mixtures thereof; and (ii) an additive having a melting point of less than about 65° C. and a boiling point of more than about 150° C. and selected from the group consisting of (A) diphenyl compounds; (B) phenyl alkanes; (C) indan compounds; (D) benzene derivatives; (E) benzyl alcohols; (F) phenyl alcohols; (G) menthol; (H) aromatic amines; and (I) mixtures thereof; (c) an optional filler; (d) an optional antistatic agent; and (e) an optional biocide. Also disclosed is a process for generating images which comprises (1) generating an electrostatic latent image on an imaging member in an imaging apparatus; (2) developing the latent image with a toner which comprises a colorant and a resin selected from the group consisting of (A) copolymers of styrene and at least one other monomer; (B) copolymers of acrylic monomers and at least one other monomer; and (C) mixtures thereof; and (3) transferring the developed image to a recording sheet which comprises (a) a substrate; (b) a coating on the substrate which comprises (i) a polymeric binder selected from the group consisting of (A) copolymers of styrene and at least one other monomer; (B) copolymers of acrylic monomers and at least one other monomer; and (C) mixtures thereof; and (ii) an additive having a melting point of less than about 65° C. and a boiling point of more than about 150° C. and selected from the group consisting of (A) diphenyl compounds; (B) phenyl alkanes; (C) indan compounds; (D) benzene derivatives; (E) benzyl alcohols; (F) phenyl alcohols; (G) menthol; (H) aromatic amines; (I)aliphatic amines; (J) aldehydes; (K) aldehyde derivatives; and (L) mixtures thereof; (c) an optional filler; (d) an optional antistatic agent; and (e) an optional biocide.

8 Claims, No Drawings

RECORDING SHEETS

This application is a continuation-in-part of application U.S. Ser. No. 08/033,932, filed Mar. 19, 1993, now U.S. Pat. No. 5,302,439 entitled "Recording Sheets", the disclosure of which is totally incorporated herein by reference.

BACKGROUND OF THE INVENTION

The present invention is directed to coated recording sheets. More specifically, the present invention is directed to recording sheets particularly suitable for use in electrophotographic printing processes. One embodiment of the present invention is directed to a recording sheet which comprises (a) a substrate; (b) a coating on the substrate which comprises (i) a binder selected from the group consisting of (A) copolymers of styrene and at least one other monomer; (B) copolymers of acrylic monomers and at least one other monomer; and (C) mixtures thereof; and (ii) an additive having a melting point of less than about 65° C. and a boiling point of more than about 150° C. and selected from the group consisting of (A) diphenyl compounds; (B) phenyl alkanes; (C) indan compounds; (D) benzene derivatives; (E) benzyl alcohols; (F) phenyl alcohols; (G) menthol; (H) aromatic amines; and (I) mixtures thereof; (c) an optional filler; (d) an optional antistatic agent; and (e) an optional biocide. Another embodiment of the present invention is directed to a process for generating images which comprises (1) generating an electrostatic latent image on an imaging member in an imaging apparatus; (2) developing the latent image with a toner which comprises a colorant and a resin selected from the group consisting of (A) copolymers of styrene and at least one other monomer; (B) copolymers of acrylic monomers and at least one other monomer; and (C) mixtures thereof; and (3) transferring the developed image to a recording sheet which comprises (a) a substrate; (b) a coating on the substrate which comprises (i) a polymeric binder selected from the group consisting of (A) copolymers of styrene and at least one other monomer; (B) copolymers of acrylic monomers and at least one other monomer; and (C) mixtures thereof; and (ii) an additive having a melting point of less than about 65° C. and a boiling point of more than about 150° C. and selected from the group consisting of (A) diphenyl compounds; (B) phenyl alkanes; (C) indan compounds; (D) benzene derivatives; (E) benzyl alcohols; (F) phenyl alcohols; (G) menthol; (H) aromatic amines; (I) aliphatic amines; (J) aldehydes; (K) aldehyde derivatives; and (L) mixtures thereof; (c) an optional filler; (d) an optional antistatic agent; and (e) an optional biocide.

U.S. Pat. No. 5,118,570 (Malhotra) and U.S. Pat. No. 5,006,407 (Malhotra), the disclosures of each of which are totally incorporated herein by reference, disclose a transparency which comprises a hydrophilic coating and a plasticizer, which plasticizer can, for example, be from the group consisting of phosphates, substituted phthalic anhydrides, glycerols, glycols, substituted glycerols, pyrrolidinones, alkylene carbonates, sulfolanes, and stearic acid derivatives.

U.S. Pat. No. 5,145,749 (Matthew) discloses erasable coatings for xerography paper which comprise a pigment such as calcium carbonate in a binder such as an aqueous emulsion of an acrylic polymer. The erasability of the coating is improved by replacing at least 15 weight percent of the binder with a polyalkane or polyalkene wax, such as an aqueous emulsion of a polyolefin.

U.S. Pat. No. 4,526,847 (Walker et al.) discloses a transparency for the formation of an adherent electrostatic image thereon which includes a polyester resin film sheet having an image-receiving coating of nitrocellulose, a plasticizer, a particulate material, and, preferably, an antistatic agent. The coating is applied to the film sheet from a solvent mixture of an aliphatic ester or an aliphatic ketone, and an aliphatic alcohol.

U.S. Pat. No. 3,619,279 (Johnston et al.) discloses a toner receiving member having available at an external surface a solid crystalline plasticizer to reduce the fusion power requirements when toner is fused to the receiving member. The external surface of the toner receiving member is substantially free of material plasticizable by the solid crystalline plasticizer. Typically a plasticizer such as ethylene glycol dibenzoate may be available on the surface of paper.

U.S. Pat. No. 3,561,337 (Mulkey) discloses a sheet material having a transparent backing coated with a layer containing a polymeric binder and particles of solid material which is insoluble in the binder. The refractive index of the solid material varies from that of the binder by at most ±0.6. The surface of the layer is ink receptive and, by printing on that surface, a transparency is obtained.

U.S. Pat. No. 3,493,412 (Johnston et al.) discloses an imaging process wherein an electrostatic latent image is developed with a thermoplastic resin toner on an imaging surface and the toner image is transferred to an image receiving surface carrying an amount of a solid crystalline plasticizer sufficient to lower the toner fusion requirements when the toner image is fused to the receiving surface.

U.S. Pat. No. 3,488,189 (Mayer et al.) discloses the formation of fused toner images on an imaging surface corresponding to an electrostatic field by depositing on the imaging surface in image configuration toner particles containing a thermoplastic resin, the imaging surface carrying a solid crystalline plasticizer having a lower melting point than the melting range of the thermoplastic resin and heat fusing the resulting toner image.

U.S. Pat. No. 4,956,225 (Malhotra) discloses a transparency suitable for electrographic and xerographic imaging which comprises a polymeric substrate with a toner receptive coating on one surface thereof comprising blends selected from the group consisting of: poly(ethylene oxide) and carboxymethyl cellulose; poly(ethylene oxide), carboxymethyl cellulose, and hydroxypropyl cellulose; poly(ethylene oxide) and vinylidene fluoride/hexafluoropropylene copolymer; poly(chloroprene) and poly(alpha-methylstyrene); poly(caprolactone) and poly(alphamethylstyrene); poly(vinyl isobutyl ether) and poly(alpha-methylstyrene); poly(caprolactone) and poly(p-isopropyl alpha-methylstyrene); blends of poly(1,4-butylene adipate) and poly(alpha-methylstyrene); chlorinated poly(propylene) and poly(alpha-methylstyrene); chlorinated poly(ethylene) and poly(alpha-methylstyrene); and chlorinated rubber and poly(alphamethylstyrene). Also disclosed are transparencies with first and second coating layers.

U.S. Pat. No. 4,997,697 (Malhotra) discloses a transparent substrate material for receiving or containing an image which comprises a supporting substrate base, an antistatic polymer layer coated on one or both sides of the substrate and comprising hydrophilic cellulosic components, and a toner receiving polymer layer contained on one or both sides of the antistatic layer, which polymer comprises hydrophobic cellulose ethers, hydrophobic cellulose esters, or mixtures thereof, and wherein the toner receiving layer contains adhesive components.

U.S. Pat. No. 5,202,205 (Malhotra), the disclosure of which is totally incorporated herein by reference, discloses a transparent substrate material for receiving or containing an image comprising a supporting substrate, an ink toner receiving coating composition on both sides of the substrate and comprising an adhesive layer and an antistatic layer contained on two surfaces of the adhesive layer, which antistatic layer comprises mixtures or complexes of metal halides or urea compounds both with polymers containing oxyalkylene segments.

U.S. Pat. No. 5,244,714 (Malhotra et al.), the disclosure of which is totally incorporated herein by reference, discloses a recording sheet which comprises a base sheet, an antistatic layer coated on at least one surface of the base sheet comprising a mixture of a first component selected from the group consisting of hydrophilic polysaccharides and a second component selected from the group consisting of poly (vinyl amines), poly (vinyl phosphates), poly (vinyl alcohols), poly (vinyl alcohol)-ethoxylated, poly (ethylene imine)-ethoxylated, poly (ethylene oxides), poly (n-vinyl acetamide-vinyl sulfonate salts), melamine-formaldehyde resins, ureaformaldehyde resins, styrene-vinylpyrrolidone copolymers, and mixtures thereof, and at least one toner receiving layer coated on an antistatic layer comprising a material selected from the group consisting of maleic anhydride containing polymers, maleic ester containing polymers, and mixtures thereof.

U.S. Pat. No. 5,302,439 (Shadi L. Malhotra and Brent S. Bryant), the disclosure of which is totally incorporated herein by reference, discloses a recording sheet which comprises (a) a substrate; (b) a coating on the substrate which comprises a binder and a material having a melting point of less than about 65° C. and a boiling point of greater than 150° C. and selected from the group consisting of alkyl phenones, alkyl ketones, halogenated alkanes, alkyl amines, alkyl anilines, alkyl diamines, alkyl alcohols, alkyl diols, halogenated alkyl alcohols, alkane alkyl esters, saturated fatty acids, unsaturated fatty acids, alkyl aldehydes, alkyl anhydrides, alkanes, and mixtures thereof; (c) an optional traction agent; and (d) an optional antistatic agent.

Copending application U.S. Ser. No. 08/196,673, entitled "Recording Sheets," with the named inventor Shadi L. Malhotra, the disclosure of which is totally incorporated herein by reference, discloses a recording sheet which comprises a substrate and a material selected from the group consisting of monomeric amine acid salts, monomeric quaternary choline halides, and mixtures thereof.

Copending application U.S. Ser. No. 08/196,607, entitled "Recording Sheets," with the named inventor Shadi L. Malhotra, the disclosure of which is totally incorporated herein by reference, discloses a recording sheet which comprises (a) a substrate; (b) a coating on the substrate which comprises (1) a binder selected from the group consisting of (A) polyesters; (B) polyvinyl acetals; (C) vinyl alcohol-vinyl acetal copolymers; (D) polycarbonates; and (E) mixtures thereof; and (2) an additive having a melting point of less than about 65° C. and a boiling point of more than about 150° C. and selected from the group consisting of (1) furan derivatives; (2) cyclic ketones; (3)lactones; (4) cyclic alcohols; (5) cyclic anhydrides; (6) acid esters; (7) phosphine oxides; and (8) mixtures thereof; (c) an optional filler; (d) an optional antistatic agent; and (e) an optional biocide. Also disclosed is a process for generating images which comprises (1) generating an electrostatic latent image on an imaging member in an imaging apparatus; (2) developing the latent image with a toner which comprises a colorant and a resin selected from the group consisting of (A) polyesters; (B) polyvinyl acetals; (C) vinyl alcohol-vinyl acetal copolymers; (D) polycarbonates; and (E) mixtures thereof; and (3) transferring the developed image to a recording sheet which comprises (a) a substrate; (b) a coating on the substrate which comprises (1) a binder selected from the group consisting of (A) polyesters; (B) polyvinyl acetals; (C) vinyl alcoholvinyl acetal copolymers; (D) polycarbonates; and (E) mixtures thereof; and (2) an additive having a melting point of less than about 65° C. and a boiling point of more than about 150° C. and selected from the group consisting of (1) furan derivatives; (2) cyclic ketones; (3) lactones; (4) cyclic alcohols; (5) cyclic anhydrides; (6) acid esters; (7) esters; (8) phenones; (9) phosphine oxides; and (10) mixtures thereof; (c) an optional filler; (d) an optional antistatic agent; and (e) an optional biocide.

While the above materials and processes are suitable for their intended purposes, a need remains for recording sheets particularly suitable for use in electrophotographic applications. In addition, a need remains for recording sheets which can be employed with xerographic toners so that the heat and energy required for fusing the toner to the recording sheet is reduced. Further, a need remains for recording sheets which can be employed with xerographic toners so that jamming of the recording sheet in the fusing apparatus is reduced. Additionally, there is a need for recording sheets suitable for use in electrophotographic applications with reduced fusing energy requirements and reduced jamming, wherein the sheets also exhibit acceptable image quality and image fix to the recording sheet.

SUMMARY OF THE INVENTION

It is an object of the present invention to provide a recording sheet with the above advantages.

It is another object of the present invention to provide recording sheets particularly suitable for use in electrophotographic applications.

It is yet another object of the present invention to provide recording sheets which can be employed with xerographic toners so that the heat and energy required for fusing the toner to the recording sheet is reduced.

It is still another object of the present invention to provide recording sheets which can be employed with xerographic toners so that jamming of the recording sheet in the fusing apparatus is reduced.

Another object of the present invention is to provide recording sheets suitable for use in electrophotographic applications with reduced fusing energy requirements and reduced jamming, wherein the sheets also exhibit acceptable image quality and image fix to the recording sheet.

These and other objects of the present invention (or specific embodiments thereof) can be achieved by providing a recording sheet which comprises (a) a substrate; (b) a coating on the substrate which comprises (i) a binder selected from the group consisting of (A) copolymers of styrene and at least one other monomer; (B)

copolymers of acrylic monomers and at least one other monomer; and ((2) mixtures thereof; and (ii) an additive having a melting point of less than about 65° C. and a boiling point of more than about 150° C. and selected from the group consisting of (A) diphenyl compounds; (B) phenyl alkanes; (C) indan compounds; (D) benzene derivatives; (E) benzyl alcohols; (F) phenyl alcohols; (G) menthol; (H) aromatic amines; and (I) mixtures thereof; (c) an optional filler; (d) an optional antistatic agent; and (e) an optional biocide. Another embodiment of the present invention is directed to a process for generating images which comprises (1) generating an electrostatic latent image on an imaging member in an imaging apparatus; (2) developing the latent image with a toner which comprises a colorant and a resin selected from the group consisting of (A) copolymers of styrene and at least one other monomer; (B) copolymers of acrylic monomers and at least one other monomer; and (C) mixtures thereof; and (3) transferring the developed image to a recording sheet which comprises (a) a substrate; (b) a coating on the substrate which comprises (i) a binder selected from the group consisting of (A) copolymers of styrene and at least one other monomer; (B) copolymers of acrylic monomers and at least one other monomer; and (C) mixtures thereof; and (ii) an additive having a melting point of less than about 65° C. and a boiling point of more than about 150° C. and selected from the group consisting of (A) diphenyl compounds; (B) phenyl alkanes; (C) indan compounds; (D) benzene derivatives; (E) benzyl alcohols; (F) phenyl alcohols; (G) menthol; (H) aromatic amines; (I) aliphatic amines; (J) aldehydes; (K) aldehyde derivatives; and (L) mixtures thereof; (c) an optional filler; (d) an optional antistatic agent; and (e) an optional biocide.

DETAILED DESCRIPTION OF THE INVENTION

The recording sheets of the present invention comprise a substrate or base sheet having a coating on one or both surfaces thereof. Any suitable substrate can be employed. Examples of substantially transparent substrate materials include polyesters, including Mylar TM, available from E. I. Du Pont de Nemours & Company, Melinex TM, available from Imperial Chemicals, Inc., Celanar TM, available from Celanese Corporation, polyethylene naphthalates, such as Kaladex PEN Films, available from Imperial Chemicals, Inc., polycarbonates such as Lexan TM, available from General Electric Company, polysulfones, such as those available from Union Carbide Corporation, polyether sulfones, such as those prepared from 4,4'-diphenyl ether, such as Udel TM, available from Union Carbide Corporation, those prepared from disulfonyl chloride, such as Victrex TM, available from ICI Americas Incorporated, those prepared from biphenylene, such as Astrel TM, available from 3M Company, poly (arylene sulfones), such as those prepared from crosslinked poly(arylene ether ketone sulfones), cellulose triacetate, polyvinylchloride cellophane, polyvinyl fluoride, polyimides, and the like, with polyester such as Mylar TM being preferred in view of its availability and relatively low cost. The substrate can also be opaque, including opaque plastics, such as Teslin TM, available from PPG Industries, and filled polymers, such as Melinex ®, available from ICI. Filled plastics can also be employed as the substrate, particularly when it is desired to make a "never-tear paper" recording sheet. Paper is also suitable, including plain papers such as Xerox ® 4024, diazo papers, or the like.

In one embodiment of the present invention, the substrate comprises sized blends of hardwood kraft and softwood kraft fibers containing from about 10 to 90 percent by weight soft wood and from about 10 to about 90 percent by weight hardwood. Examples of hardwood include Seagull W dry bleached hardwood kraft, present in one embodiment in an amount of about 70 percent by weight. Examples of softwood include La Tuque dry bleached softwood kraft, present in one embodiment in an amount of about 30 percent by weight. These substrates can also contain fillers and pigments in any effective amounts, typically from about 1 to about 60 percent by weight, such as clay (available from Georgia Kaolin Company, Astro-fil 90 clay, Engelhard Ansilex clay), titanium dioxide (available from Tioxide Company - Anatase grade AHR), calcium silicate CH-427-97-8, XP-974 (J. M. Huber Corporation), and the like. The sized substrates can also contain sizing chemicals in any effective amount, typically from about 0.25 percent to about 25 percent by weight of pulp, such as acidic sizing, including Mon size (available from Monsanto Company), alkaline sizing such as Hercon-76 (available from Hercules Company), Alum (available from Allied Chemicals as Iron free alum), retention aid (available from Allied Colloids as Percol 292), and the like. The preferred internal sizing degree of papers selected for the present invention, including commercially available papers, varies from about 0.4 to about 5,000 seconds, and papers in the sizing range of from about 0.4 to about 300 seconds are more preferred, primarily to decrease costs. Preferably, the selected substrate is porous, and the porosity value of the selected substrate preferably varies from about 100 to about 1,260 milliliters per minute and preferably from about 50 to about 600 milliliters per minute to enhance the effectiveness of the recording sheet in ink jet processes. Preferred basis weights for the substrate are from about 40 to about 400 grams per square meter, although the basis weight can be outside of this range.

Illustrative examples of commercially available internally and externally (surface) sized substrates suitable for the present invention include Diazo papers, offset papers, such as Great Lakes offset, recycled papers, such as Conservatree, office papers, such as Automimeo, Eddy liquid toner paper and copy papers available from companies such as Nekoosa, Champion, Wiggins Teape, Kymmene, Modo, Domtar, Veitsiluoto and Sanyo, and the like, with Xerox ® 4024 TM papers and sized calcium silicate-clay filled papers being particularly preferred in view of their availability, reliability, and low print through. Pigmented filled plastics, such as Teslin (available from PPG industries), are also preferred as supporting substrates.

The substrate can be of any effective thickness. Typical thicknesses for the substrate are from about 50 to about 500 microns, and preferably from about 100 to about 125 microns, although the thickness can be outside these ranges.

Coated on one or both surfaces of the base sheet is a coating. This coating can be either coated directly onto the base sheet or coated onto another layer of material coated onto the base sheet previously, such as an antistatic layer, an anticurl layer, or the like. This coating comprises (i) a binder selected from the group consisting of (A) copolymers of styrene and at least one other monomer; (B) copolymers containing acrylic monomers and at least one other monomer; and (C) mixtures thereof; and (ii) an additive having a melting point of less than about 65° C. and a boiling point of more than about 150° C. and selected from the group consisting of (A) diphenyl compounds; (B) phenyl alkanes; (C) indan compounds; (D) benzene derivatives; (E) benzyl alcohols; (F) phenyl alcohols; (G) menthol; (H) aromatic amines; (I) aliphatic amines; (J) aldehydes; (K) aldehyde derivatives; and (L) mixtures thereof.

Examples of suitable binder polymers include styrene-butadiene copolymers, such as those containing about 85 percent by weight styrene monomers and prepared as disclosed in U.S. Pat. No. 4,558,108, the disclosure of which is totally incorporated herein by reference, styrene-butadiene copolymers containing from about 5 to about 50 percent by weight styrene monomers and available as #199, #200, #201, #451, and #057 from Scientific Polymer Products, and the like; styrene-isoprene copolymers, such as those with a styrene content of 50 percent by weight or more and prepared via living anionic polymerization techniques as disclosed by S. Malhotra et al. in *J. Macromol. Science - Chem.* A(20)7, page 733, the disclosure of which is totally incorporated herein by reference, and the like; styrene-alkyl methacrylate copolymers, wherein alkyl is methyl, ethyl, isopropyl, butyl, hexyl, isodecyl, dodecyl, hexadecyl, octadecyl, or the like, such as those prepared via ultrasonic polymerization as described by S. Malhotra et al. in *J. Macromol. Science - Chem.* A18(5), page 783, the disclosure of which is totally incorporated herein by reference, or the like; styrene-aryl methacrylate copolymers, wherein aryl is phenyl, benzyl, or the like, such as those prepared via ultrasonic polymerization as described by S. Malhotra et al. in *J. Macromol. Science - Chem.* A18(5), page 783, or the like; styrene-butylmethacrylate copolymers, such as #595, available from Scientific Polymer Products, or the like; styrene-allyl alcohol copolymers, such as #393 and #394, available from Scientific Polymer Products, or the like; styrene-maleic anhydride copolymers, such as those containing from about 50 to about 75 percent by weight styrene monomers, including #456, #049, #457, and #458, available from Scientific Polymer Products, or the like; and the like, as well as mixtures thereof.

The coating also contains a non-polymeric component selected from the group consisting of diphenyl compounds, phenyl alkanes, indan compounds, benzene derivatives, benzyl alcohols, phenyl alcohols, menthol, aromatic amines, aliphatic amines, aldehydes, aldehyde derivatives, and mixtures thereof.

Diphenyl compounds are compounds having at least two phenyl groups, and may be hydrocarbons or substituted hydrocarbons. Examples of suitable diphenyl compounds include (1) diphenyl methane $(C_6H_5)_2CH_2$ (Aldrich D20,931-7); (2) 1,2-diphenyl ethane $C_6H_5CH_2CH_2C_6H_5$ (Aldrich B3,370-6); (3) 2,2-diphenyl ethanol $(C_6H_5)_2CHCH_2OH$ (Aldrich 19,656-8); (4) 2-bromo diphenyl $C_6H_5C_6H_4Br$ (Aldrich 25,224-7); (5) 2-methoxy diphenyl $C_6H_5C_6H_4OCH_3$ (Aldrich 19,646-0); (6) 2-phenoxy diphenyl $C_6H_5C_6H_4OC_6H_5$ (Aldrich 26,354-0); (7) 4-phenoxy diphenyl $C_6H_5C_6H_4OC_6H_5$; (8) 4-methyl diphenyl $C_6H_5C_6H_4CH_3$ (Aldrich 3,660-6); (9) 4-hexyl diphenyl $C_6H_5C_6H_4(CH_2)_5CH_3$ (Aldrich 22,208-9); (10) 4-phenyl biphenyl $C_6H_5C_6H_4C_6H_5$ (Aldrich T 280-0); (11) diphenyl acetaldehyde $(C_6H_5)_2CHCHO$ (Aldrich D20,425-0); (12) 1,1-diphenyl acetone $(C_6H_5)_2CHCOCH_3$ (Aldrich D20,440-4); (13) 1,3diphenyl acetone $C_6H_5CH_2COCH_2C_6H_5$(Aldrich D20,460-9); (14) diphenyl acetylene $C_6H_5C{=}CC_6H_5$ (Aldrich D20,480-3); (15) diphenyl amine $(C_6H_5)_2NH$ (Aldrich 24,258-6); (16) diphenyl chlorophosphate $(C_6H_5O)_2P(O)Cl$ (D20,655-5); (17) 1,2-diphenyl ethylamine $C_6H_5CH_2(C_6H_5)NH_2$ (Aldrich 13,702-2); (18) 2,2-diphenyl ethyl amine $(C_6H_5)_2CHCH_2NH_2$ (Aldrich D20,670-9); (19) 1,1-diphenyl ethylene $(C_6H_5)_2C{=}CH_2$ (Aldrich D20,680-6); (20) diphenyl phosphate $(C_6H_5O)_2P(O)OH$ (Aldrich 85,060-8); (21) 2,2-diphenyl propane $CH_3C(C_6H_5)_2CH_3$ (Aldrich D21,150-8); (22) 1,1-diphenyl-2-propanol $(C_6H_5)_2CHCH(OH)CH_3$ (Aldrich 19,075-6); (23) 3,3-diphenyl-1-propanol $(C_6H_5)_2CHCH_2CH_2OH$ (Aldrich 18,897-2); (24) 3,3-diphenyl propylamine $(C_6H_5)_2CHCH_2CH_2NH_2$ (Aldrich 13,629-8); (25) diphenyl-2-pyridylmethane (Aldrich D 21,280-6); (26) 2-bromo-2,2-diphenyl acetyl bromide $BrC(C_6H_5)_2COBr$ (Aldrich 16,446-1); (27) 4-bromodiphenyl ether $BrC_6H_4OC_6H_5$ (Aldrich B6,520-9); (28) bromodiphenylmethane $(C_6H_5)_2CHBr$ (Aldrich B6,540-3); (29) 2-chloro-2,2-diphenyl acetyl chloride $ClC(C_6H_5)_2COCl$ (Aldrich C3,928-8); (30) 3-chloro diphenyl amine $ClC_6H_4NHC_6H_5$ (Aldrich 13,095-8); (31) 4-chloro diphenyl ether $ClC_6H_4OC_6H_5$ (Aldrich 35,765-0); (32) 4-hydroxy diphenyl methane $C_6H_5CH_2C_6H_4OH$ (Aldrich 14,252-2); (33) amino diphenyl methane $(C_6H_5)_2CHNH_2$ (Aldrich A5,360-5); (34) 1,1-bis(3,4-dimethyl phenyl) ethane $[(CH_3)_2C_6H_3]_2CHCH_3$ (Aldrich 24,309-4); and the like, as well as mixtures thereof.

Phenyl alkane compounds are otherwise saturated aliphatic hydrocarbons having a phenyl group substituent. Examples of suitable phenyl alkanes include (1) 1-phenyl hexane $C_6H_5(CH_2)_5CH_3$ (Aldrich 2,570-1); (2) 1-phenyl heptane $C_6H_5(CH_2)_6CH_3$ (Aldrich 11,318-2); (3) 1-phenyl octane $C_6H_5(CH_2)_7CH_3$ (Aldrich 11,319-0); (4) 1-phenyl nonane $C_6H_5(CH_2)_8CH_3$ (Aldrich 11,320-4); (5) 1-phenyl decane $C_6H_5(CH_2)_9CH_3$ (Aldrich 11,321-2); (6) 1-phenyl dodecane $C_6H_5(CH_2)_{11}CH_3$ (Aldrich 11,323-9); (7) 1-phenyl tridecane $C_6H_5(CH_2)_{12}CH_3$ (Aldrich 11,324-7); and the like, as well as mixtures thereof.

Indan compounds are those of the general formula

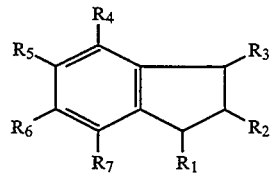

wherein $R_1$, $R_2$, $R_3$, $R_4$, $R_5$, $R_6$, and $R_7$ each, independently of one another, can be (but are not limited to) hydrogen, alkyl, substituted alkyl, hydroxy, alkoxy, oxo, or the like. Other variations are also possible, such as the presence of one or more double bonds in the five-membered ring, a double bond between one of the carbon atoms in the five-membered ring and another atom, such as oxygen, carbon, sulfur, nitrogen, or the like, and the like. Examples of suitable indan compounds include (1) indan (Aldrich I180-4), of the formula:

(1) indan (Aldrich I-180-4), of the formula:

-continued

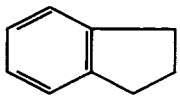

(2) indene (Aldrich I-280-0), of the formula:

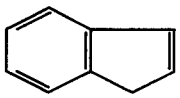

(3) 1-indanone (Aldrich I-230-4), of the formula:

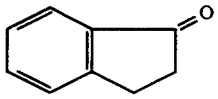

(4) 2-indanone (Aldrich 14,669-2), of the formula:

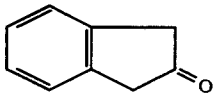

(5) 1-indanol (Aldrich 19,373-9), of the formula:

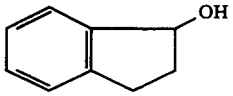

(6) 2-indanol (Aldrich 18,035-1), of the formula:

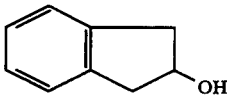

(7) 5-indanol (Aldrich I-221-5), of the formula:

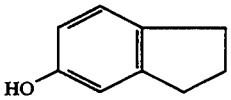

(8) 5-methoxy indan (Aldrich 27,229-9), of the formula:

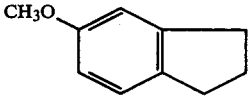

and the like, as well as mixtures thereof.

Benzene derivative compounds are those wherein a benzene ring has one or more substituents other than hydrogen, with examples of substituents including (but not being limited to) alkyl (including cyclic alkyl), alkoxy, halogen, or the like. Examples of suitable benzene derivatives include (1) pentamethyl benzene ($C_6H(CH_3)_5$) (Aldrich 15,361-3); (2) 1,2,3,4-tetramethyl benzene ($C_6H_2(CH_2)_4$) (Aldrich 15,360-5); (3) 1,2,3,5-tetramethyl benzene (Aldrich 15,365-6); (4) 1,2,3-trimethyl benzene ($C_6H_3(CH_3)_3$) (Aldrich T7,320-2); (5) 1,2,4-trimethyl benzene (Aldrich 24,027-3); (6) 1,3,5-trimethoxy benzene ($C_6H_3(OCH_3)_3$) (Aldrich 13,882-7); (7) 1,2,4-trimethoxy benzene (Aldrich T6,880-2); (8) 1,2,3-trimethoxybenzene (Aldrich 13,799-5); (9) 1,2,4-tribromo benzene ($C_6H_3Br_3$) (Aldrich 13,275-6); (10) 1,2,3-trichlorobenzene ($C_6H_3Cl_3$) (Aldrich T5,440-2); (11) 1,2,4trichlorobenzene (Aldrich 25,641-2); (12) 1,3,5-trichlorobenzene (Aldrich T5,460-7); (13) 2-bromo mesitylene ($1,3,5-(CH_3)_3C_6H_2Br$) (Aldrich B7,160-8); (14) 1,3,5-triethyl benzene ($C_6H_3(C_2H_5)_3$) (Aldrich 13,207-1); (15) 1,2,4triethylbenzene (Aldrich 35,876-2); (16) cyclopropyl benzene $C_6H_5C_3H_5$ (Aldrich 15,801-1); (17) cyclohexyl benzene $C_6H_5C_6H_{11}$(Aldrich C10,480-9); and the like, as well as mixtures thereof.

Benzyl alcohol compounds include benzyl alcohol and substituted benzyl alcohols, wherein substituents can include (but are not limited to) alkyl, substituted alkyl, alkoxy, aryl, substituted aryl, aryloxy, arylalkyl, substituted arylalkyl, arylalkyloxy, halogen, hydroxyl, or the like. Examples of suitable benzyl alcohols include (1) benzyl alcohol $C_6H_5CH_2OH$ (Aldrich 30,519-7); (2) 2-methyl benzyl alcohol $CH_3C_6H_4CH_2OH$ (Aldrich 18,847-6); (3) 3-methyl benzyl alcohol (Aldrich 18,821-2); (4) 4-methyl benzyl alcohol (Aldrich 12,780-9); (5) 2-methoxy benzyl alcohol ($CH_3OC_6H_4CH_2OH$) (Aldrich M1,080-8); (6) 3-methoxybenzyl alcohol (Aldrich M1,100-8); (7) 4-methoxybenzyl alcohol (Aldrich 13,690-5); (8) 2-ethoxy benzyl alcohol ($C_2H_5OC_6H_4CH_2OH$) (Aldrich 19,066-7); (9) 4-ethoxy benzyl alcohol (Aldrich 19,047-0); (10) 4-butoxy benzyl alcohol ($CH_3(CH_2)_3OC_6H_4CH_2OH$) (Aldrich 18,424-1); (11) 2-phenyl benzyl alcohol ($C_6H_5C_6H_4CH_2OH$) (Aldrich 18,882-4); (12) 2-phenethyl benzyl alcohol $C_6H_5CH_2CH_2C_6H_4CH_2OH$ (Aldrich 18,478-0); (13) 3-benzyloxy benzyl alcohol ($C_6H_5CH_2OC_6H_4CH_2OH$) (Aldrich 18,732-1); (14) 2-hydroxy-3-methoxy benzyl alcohol $HOC_6H_3(OCH_3)CH_2OH$ (Aldrich 30,596-0); (15) 3-ethoxy-4-methoxy benzyl alcohol $C_2H_5OC_6H_3(OCH_3)CH_2OH$ (Aldrich 30,790-4); (16) 4-ethoxy-3-methoxy benzyl alcohol $C_2H_5OC_6H_3(OCH_3)CH_2OH$ (Aldrich 18,914-6); (17) 2,3-dimethoxy benzyl alcohol ($(CH_3O)_2C_6H_3CH_2OH$)-(Aldrich 12,631-4); (18) 2,4-dimethoxy benzyl alcohol (Aldrich 15,963-8); (19) 3,5-dimethoxy benzyl alcohol (Aldrich 19,165-5); (20) 3,4,5-trimethoxy benzyl alcohol $(CH_3O)_3C_6H_2CH_2OH$ (Aldrich T7,000-9); (21) 4-chloro benzyl alcohol ($ClC_6H_4CH_2OH$) (Aldrich C2,711-5); (22) 3,4-dimethyl benzyl alcohol ($(CH_3)_2C_6H_3CH_2OH$) (Aldrich 18,879-4); (23) 2,4-dimethyl benzyl alcohol (Aldrich 18,878-6); (24) 2,5 dimethyl benzyl alcohol (Aldrich 18,932-4); (25) 3,5-dimethyl benzyl alcohol (Aldrich 19,999-0); and the like, as well as mixtures thereof.

Phenyl alcohol compounds are generally compounds having both a phenyl functional group and an alcohol functional group. Examples of suitable phenyl alcohols include (1) 3-phenyl-1-propanol $C_6H_5(CH_2)_3OH$ (Aldrich 14,085-6); (2) 2-phenyl-2-propanol $C_6H_5C(CH_3)2OH$ (Aldrich P3,080-2); (3) 1-phenyl-2-propanol $C_6H_5CH_2CH(OH)CH_3$ (Aldrich 18,923-5); (4) (S)-(-)-1-phenyl-1-butanol $CH_3CH_2CH_2CH(C_6H_5)OH$ (Aldrich 31,732-2); (5) 3-phenoxy-1,2-propane diol $C_6H_5OCH_2CH(OH)CH_2OH$ (Aldrich 25,781-8); (6) 2-hydroxy phenethyl alcohol $HOC_6H_4CH_2CH_2OH$ (Aldrich 18,824-7); (7) 3-hydroxy phenethyl alcohol $HOC_6H_4CH_2CH_2OH$ (Aldrich 19,902-8); (8) 3-(4-hydroxy phenyl)-1-propanol $HOC_6H_4(CH_2)_3OH$ (Aldrich 19,741-6); (9) 2,3,6-trimethyl phenol $(CH_3)_3C_6H_2OH$ (Aldrich T7,870-0); (10) 3-methoxy catechol $CH_3OC_6H_3$-1,2-$(OH)_2$ (Aldrich M1320-3); (11) 4-methyl benzhydrol $CH_3C_6H_4CH(C_6H_5)OH$ (Aldrich 18,995-2); (12) 4-methoxy phenethyl alcohol $CH_3OC_6H_4CH_2CH_2OH$ (Aldrich 15,418-0); (13) 3,4-dimethoxy phenethyl alcohol $(CH_3O)_2C_6H_3CH_2CH_2OH$ (Aldrich 19,765-3); (14) 2-phenyl-1,2-propane diol $CH_3C(C_6H_5)(OH)CH_2OH$ (Aldrich 21,376-4); (15) 2-benzyloxy ethanol $C_6H_5CH_2OCH_2CH_2OH$ (Aldrich 25,286-7); (16) cinnamyl alcohol $C_6H_5CH{=}CHCH_2OH$ (Aldrich 10,819-7); and the like, as well as mixtures thereof.

Also suitable is menthol (Aldrich M 277-2), of the formula:

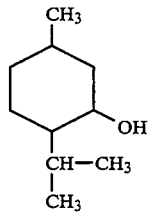

Aromatic and aliphatic amines generally are compounds of the formula NRR'R'', wherein R, R', and R'' each, independently of one another, can be hydrogen, alkyl (including cyclic alkyl), substituted alkyl, aryl, substituted aryl, arylalkyl, or substituted arylalkyl. Examples of suitable aromatic and aliphatic amines include (1) benzyl amine $C_6H_5CH_2NH_2$ (Aldrich 18,570-1); (2) 2-methyl benzyl amine ($CH_3C_6H_4CH_2NH_2$) (Aldrich 12,713-2); (3) 3-methyl benzyl amine (Aldrich 12,682-9); (4) 4-methyl benzyl amine (Aldrich M3,120-1); (5) 2-methoxy benzyl amine ($CH_3OC_6H_4CH_2NH_2$) (Aldrich 15,988-3); (6) 3-methoxy benzyl amine (Aldrich 15,989-1); (7) 4-methoxy benzyl amine (Aldrich M1,110-3); (8) 4-chloro benzyl amine ($ClC_6H_4CH_2NH_2$) (Aldrich C2,740-9); (9) N-phenyl benzyl amine $C_6H_5CH_2NHC_6H_5$ (Aldrich 18,549-3); (10) 3-chloro diphenyl amine $ClC_6H_4NHC_6H_5$ (Aldrich 13,095-8); (11) 2,2-diphenyl ethyl amine $(C_6H_5)_2CHCH_2NH_2$ (Aldrich D20,670-9); (12) tripropanol amine $[CH_3CH(OH)CH_2]_3N$ (Aldrich 25,474-6); (13) triethylene tetra amine hydrate $H_2NCH_2CH_2NHCH_2CH_2NHCH_2CH_2NH_2.xH_2O$ (Aldrich 25,953-5); (14) N,N,N',N'-tetramethyl-1,4-butane diamine $(CH_3)_2N(CH_2)_4N(CH_3)_2$ (Aldrich 12,710-8); (15) N,N,N',N'-tetramethyl-1,3-butane diamine $(CH_3)_2NCH(CH_3)CH_2N(CH_3)_2$ (Aldrich T2,060-5)); (16) N,N,N',N'-tetraethyl ethylene diamine $(C_2H_5)_2NCH_2CH_2N(C_2H_5)_2$ (Aldrich 12,707-8); (17) tetra ethylene pentamine $NH(CH_2CH_2NHCH_2CH_2NH_2)_2$ (Aldrich T1,150-9); (18) 2xylylene diamine ($C_6H_4(CH_2NH_2)_2$) (Aldrich X120-2); (19) 4-xylylene diamine (Aldrich 27,963-3); (20) 2-methoxy phenethyl amine ($CH_3OC_6H_4CH_2CH_2NH_2$) (Aldrich 18,780-1); (21) 4-methoxy phenethyl amine (Aldrich 18,730-5); (22) 1,4-diamino cyclohexane $C_6H_{10}(NH_2)_2$ (Aldrich 33,997-0); and the like, as well as mixtures thereof.

Also suitable are aniline derivatives, such as (1) 3-benzyloxy aniline ($C_6H_5CH_2OC_6H_4NH_2$) (Aldrich 10,080-3); (2) 2-methyl aniline ($CH_3C_6H_4NH_2$) (Aldrich T3,700-1); (3) 3-methyl aniline (Aldrich 13,201-2); (4) 4-methyl aniline (Aldrich 23,631-4); (5) 2-chloro aniline ($ClC_6H_4NH_2$) (Aldrich C2,239-3); (6) 4-chloro aniline (Aldrich C2,241-5); (7) 2-bromo aniline ($BrC_6H_4NH_2$) (Aldrich B5642-0); (8) 3-bromo aniline (Aldrich 18,002-5); (9) 4-bromo aniline (Aldrich 10,090-0); (10) 4-bromo-2,6-dimethyl aniline ($BrC_6H_2(CH_3)_2NH_2$) (Aldrich 19,237-6); (11) 2,4,6-trimethyl aniline $(CH_3)_3C_6H_2NH_2$ (Aldrich 13,217-9); (12) 2-phenoxy aniline ($C_6H_5OC_6H_4NH_2$) (Aldrich 34,668-3); (13) 4-butoxy aniline ($CH_3(CH_2)_3OC_6H_4NH_2$) (Aldrich 23,234-3); (14) 4-butyl aniline ($C_2H_5CH(CH_3)C_6H_4NH_2$) (Aldrich 30,117-5); (15) 4-cyclohexyl aniline ($C_6H_{11}C_6H_4NH_2$) (Aldrich 21,797-2); (16) p-methoxy aniline ($CH_3OC_6H_4NH_2$) (Aldrich A8,825-5); (17) 2,4-dimethoxy aniline [$(CH_{30})_2C_6H_3NH_2$](Aldrich D12,980-1); (18) 3,5-dimethoxy aniline (Aldrich D13,000-1); (19) 3,4-dimethyl aniline [$(CH_3)_2C_6H_3NH_2$](Aldrich 12,637-3); (20) 2,6-dimethyl aniline (Aldrich D14,600-5); and the like, as well as mixtures thereof.

Aldehyde compounds generally are those of the formula RCHO, wherein R can be (but is not limited to) hydrogen, alkyl (including cyclic alkyl), substituted alkyl, aryl, substituted aryl, arylalkyl, substituted arylalkyl, or the like. Examples of suitable aldehydes and aldehyde derivatives include benzaldehyde and its derivatives, such as (1) benzaldehyde $C_6H_5CHO$ (Aldrich B133-4); (2) 2-chloro benzaldehyde ($ClC_6H_4CHO$) (Aldrich 12,497-4); (3) 3-chloro benzaldehyde (Aldrich C2,340-3); (4) 4-chloro benzaldehyde (Aldrich 11,221-6); (5) 2-bromo benzaldehyde ($BrC_6H_4CHO$) (Aldrich B5,700-1); (6) 3-bromo benzaldehyde (Aldrich B5,720-6); (7) 4-bromobenzaldehyde (Aldrich B5,740-0); (8) 2-methoxy benzaldehyde ($CH_3OC_6H_4CHO$) (Aldrich 10,962-2); (9) 3-methoxy benzaldehyde (Aldrich 12,965-8); (10) 4-methoxy benzaldehyde (Aldrich A8,810-7); (11) 2-methyl benzaldehyde ($CH_3C_6H_4CHO$) (Aldrich 11,755-2); (12) 3-methyl benzaldehyde (Aldrich T3,550-5); (13)4-methyl benzaldehyde (Aldrich T3,560-2); (14) 4-acetoxy benzaldehyde ($CH_3CO_2C_6H_4CHO$) (Aldrich 24,260-8); (15) 2,3-dimethoxy benzaldehyde $(CH_{30})_2C_6H_3CHO$ (Aldrich D13,020-6); (16) 2,5-dimethoxy benzaldehyde (Aldrich D13,060-5); (17) 3,4-dimethoxy benzaldehyde (Aldrich 14,375); (18) 3,5-dimethoxy benzaldehyde (Aldrich 12,629-2); (19) 2,3,4-trimethoxy benzaldehyde $(CH_{30})_3C_6H_2CHO$) (Aldrich 15,209-9); (20) 3-benzyloxy benzaldehyde ($C_6H_5CH_2OC_6H_4CHO$) (Aldrich B2,700-5); (21) 4-phenoxy benzaldehyde ($C_6H_5OC_6H_4CHO$) (Aldrich 21,126-5); (22) 3-phenoxy benzaldehyde (Aldrich 19,175-2); (23) 4-phenyl benzaldehyde ($C_6H_5C_6H_4CHO$) (Aldrich B3468-0); (24) 3-benzyloxy-4-methoxy benzaldehyde $C_6H_5CH_2OC_6H_3(OCH_3)CHO$ (Aldrich 16,395-3); (25) 4-benzyloxy-3-methoxy benzaldehyde (Aldrich 16,361-9); (26) 2,4-dimethoxy-3-methylbenzaldehyde $(CH_{30})_2C_6H_2(CH_3)CHO$ (Aldrich 29,627-9); (27) 3-ethoxy-4-methoxy benzaldehyde $C_2H_5OC_6H_3(OCH_3)CHO$ (Aldrich 25,275-1); (28) 2-ethoxy benzaldehyde $C_2H_5OC_6H_4CHO$ (Aldrich 15,372-9); (29) 4-ethoxy benzaldehyde (Aldrich 17,360-6); (30)2-hydroxy-3-methoxy benzaldehyde $CH_3OC_6H_3$-2-(OH)CHO (Aldrich 12080-4); (31) 2-hydroxy-4-methoxy benzaldehyde (Aldrich 16,069-2); (32) 4-butoxybenzaldehyde $CH_3(CH_2)_3OC_6H_4CHO$ (Aldrich 23,808-2); (33) 2-hydroxy benzaldehyde (2(OH)$C_6H_4CHO$) (Aldrich S35-6); (34) 4-diethyl amino benzaldehyde ($(C_2H_5)_2NC_6H_4CHO$) (Aldrich D8,625-6); (35) 1,2,3,6-tetrahydro benzaldehyde ($C_6H_9CHO$) (Aldrich T1220-3); cinnamaldehydes, such as (36) trans-cinnamaldehyde $C_6H_5CH{=}CHCHO$ (Aldrich 23,996-8); (37) α-bromo cinnaldehyde $C_6H_5CH{=}C(Br)CHO$ (Aldrich 16,116-0); (38) α-chloro cinnaldehyde $C_6H_5CH{=}C(Cl)CHO$ (Aldrich 16,141-1); other aldehydes, such as (39) cyclohexane carboxaldehyde ($C_6H_{11}CHO$) (Aldrich 10,846-4); and the like, as well as mixtures thereof.

Mixtures of any two or more of the above additive materials can also be employed.

The binder can be present within the coating in any effective amount; typically the binder and the additive material are present in relative amounts of from about 10 percent by weight binder and about 90 percent by weight additive material to about 99 percent by weight binder and about 1 percent by weight additive material, although the relative amounts can be outside of this range.

In addition, the coating of the recording sheets of the present invention can contain optional filler components. Fillers can be present in any effective amount provided that the substantial transparency of the recording sheet is maintained, and if present, typically are present in amounts of from about 0.5 to about 5.0 percent by weight of the coating composition. Examples of filler components include colloidal silicas, such as Syloid 74, available from Grace Company, titanium dioxide (available as Rutile or Anatase from NL Chem Canada, Inc.), hydrated alumina (Hydrad TMC-HBF, Hydrad TM-HBC, available from J. M. Huber Corporation), barium sulfate (K.C. Blanc Fix HD80, available from Kali Chemic Corporation), calcium carbonate (Microwhite Sylacauga Calcium Products), high brightness clays (such as Engelhard Paper Clays), calcium silicate (available from J. M. Huber Corporation), cellulosic materials insoluble in water or any organic solvents (such as those available from Scientific Polymer Products), blends of calcium fluoride and silica, such as Opalex-C available from Kemira.O.Y, zinc oxide, such as Zoco Fax 183, available from Zo Chem, blends of zinc sulfide with barium sulfate, such as Lithopane, available from Schteben Company, and the like, as well as mixtures thereof.

Further, the coating of the recording sheets of the present invention can contain optional antistatic components. Antistatic components can be present in any effective amount, and if present, typically are present in amounts of from about 0.5 to about 5.0 percent by weight of the coating composition. Examples of antistatic components include both anionic and cationic materials. Examples of anionic antistatic components include monoester sulfosuccinates, such as those of the general formula

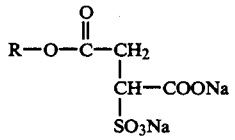

wherein R represents an alkanolamide or ethoxylated alcohol, diester sulfosuccinates, such as those of the general formula

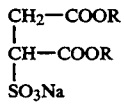

wherein R represents an alkyl group, and sulfosuccinamates, such as those of the general formula

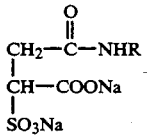

wherein R represents an alkyl group, all commercially available from Alkaril Chemicals as, for example, Alkasurf SS-L7DE, Alkasurf SS-L-HE, Alkasurf SS-OA-HE, Alkasurf SS-L9ME, Alkasurf SS-DA4-HE, Alkasurf SS-1B-45, Alkasurf SS-MA-80, Alkasurf SS-NO, Alkasurf SS-0-40, alkasurf SS-0-60PG, Alkasurf SS-0-70PG, Alkasurf SS-0-75, Alkasurf SS-TA, and the like. Examples of cationic antistatic components include diamino alkanes, such as those available from Aldrich Chemicals, quaternary salts, such as Cordex AT-172 and other materials available from Finetex Corp., and the like. Other suitable antistatic agents include quaternary acrylic copolymer latexes, particularly those of the formula

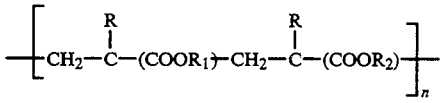

wherein n is a number of from about 10 to about 100, and preferably about 50, R is hydrogen or methyl, $R_1$ is hydrogen, an alkyl group, or an aryl group, and $R_2$ is $N^+(CH_3)_3X^-$, wherein X is an anion, such as CI, Br, I, $HSO_3$, $SO_3$, $CH_2SO_3$, $H_2PO_4$, $HPO_4$, $PO_4$, or the like, and the degree of quaternization is from about 1 to about 100 percent, including polymers such as polymethyl acrylate trimethyl ammonium chloride latex, such as HX42-1, available from Interpolymer Corp., or the like.

Also suitable as antistatic agents are quaternary choline halides. Examples of suitable quaternary choline halides include (1) choline chloride [(2-hydroxyethyl) trimethyl ammonium chloride] $HOCH_2CH_2N(CH_3)_3CI$ (Aldrich 23,994-1) and choline iodide $HOCH_2CH_2N(CH_3)_{31}$ (Aldrich C7,971-9); (2) acetyl choline chloride $CH_3COOCH_2CH_2N(CH_3)_3CI$ (Aldrich 13,535-6), acetyl choline bromide $CH_3COOCH_2CH_2N(CH_3)_3Br$ (Aldrich 85,968-0), and acetyl choline iodide $CH_3COOCH_2CH_2N(CH_3)_{31}$ (Aldrich 10,043-9); (3) acetyl-$\beta$-methyl choline chloride $CH_3COOCH(CH_3)CH_2N(CH_3)CI$ (Aldrich A1,800-1) and acetyl-$\beta$-methyl choline bromide $CH_3COOCH(CH_3)CH_2N(CH_3)_3Br$ (Aldrich 85,554-5); (4) benzoyl choline chloride $C_6H_5COOCH_2CH_2N(CH_3)_3CI$ (Aldrich 21,697-6); (5) carbamyl choline chloride $H_2NCOOCH_2CH_2N(CH_3)_3CI$ (Aldrich C240-9); (6) D,L-carnitinamide hydrochloride $H_2NCOCH_2CH(OH)CH_2N(CH_3)_3CI$ (Aldrich 24,783-9); (7) D,L-carnitine hydrochloride $HOOCCH_2CH(OH)CH_2N(CH_3)_3CI$ (Aldrich C1,600-8); (8) (2-bromo ethyl) trimethyl ammonium chloride [bromo choline chloride] $BrCH_2CH_2N(CH_3)_3Br$ (Aldrich 11,719-6); (9) (2-chloro ethyl) trimethyl ammonium chloride [chloro choline chloride) $CICH_2CH_2N(CH_3)_3CI$ (Aldrich 23,443-5); (10) (3-carboxy propyl) trimethyl ammonium chloride $HOOC(CH_2)_3N(CH_3)_3CI$ (Aldrich 26,365-6); (11) butyryl choline chloride $CH_3CH_2CH_2COOCH_2CH_2N(CH_3)_3CI$ (Aldrich 85,537-5); (12) butyryl thiocholine iodide $CH_3CH_2CH_2COSCH_2CH_2N(CH_3)_3I$ (Aldrich B10,425-6); (13) S-propionyl thiocholine iodide $C_2H_5COSCH_2CH_2N(CH_3)I$ (Aldrich 10,412-4); (14) S-acetylthiocholine bromide $CH_3COSCH_2CH_2N(CH_3)_3Br$ (Aldrich 85,533-2) and S-acetylthiocholine iodide $CH_3COSCH_2CH_2N(CH_3)_3I$ (Aldrich A2,230-0); (15) suberyl dicholine dichloride $[-(CH_2)_3COOCH_2CH_2N(CH_3)_3Cl]_2$ (Aldrich 86,204-5) and suberyl dicholine diiodide $[-(CH_2)_3COOCH_2CH_2N(CH_3)_3I]_2$ (Aldrich 86,211-8); and the like, as well as mixtures thereof.

Additional examples of materials suitable as antistatic components include those disclosed in copending applications 08/034,917, 08/033,917, and 08/033,918, and U.S. Pat. Nos. 5,314,747 and 5,320,902 the disclosures of each of which are totally incorporated herein by reference.

The antistatic agent can be present in any effective amount; typically, the antistatic agent is present in an amount of from about 1 to about 5 percent by weight of the coating, and preferably in an amount of from about 1 to about 2 percent by weight of the coating, although the amount can be outside these ranges.

Further, the coating of the recording sheets of the present invention can contain one or more optional biocides. Examples of suitable biocides include (A) non-ionic biocides, such as (1) 2-hydroxypropylmethane thiosulfonate (Busan 1005, available from Buckman Laboratories Inc.); (2) 2-(thio cyanomethyl thio) benzothiazole (Busan 30WB, 72WB, available from Buckman Laboratories Inc.); (3) methylene bis (thiocyanate) (Metasol T-10, available from Calgon Corporation; AMA-110, available from Vinings Chemical Company; Vichem MBT, available from Vineland Chemical Company; Aldrich 10,509-0); (4)2-bromo-4'-hydroxyacetophenone (Busan 90, available from Buckman Laboratories); (5) 1,2-dibromo-2,4-dicyanobutane (Metasol CB-210, CB-235, available from Calgon Corporation); (6) 2,2-dibromo-3-nitropropionamide (Metasol RB-20, available from Calgon Corporation; Amerstat 300, available from Drew Industrial Div.); (7) N-α-(1-nitroethyl benzylethylene diamine) (Metasol J-26, available from Calgon Corporation); (8) dichlorophene (G-4, available from Givaudan Corporation); (9) 3,5-dimethyl tetrahydro-2H-1,3,5-thiadiazine-2-thione (SLIME-TROL RX-28, available from Betz Paper Chem Inc.; Metasol D3T-A, available from Calgon Corporation; SLIME ARREST, available from Western Chemical Company); (10) a non-ionic blend of a sulfone, such as bis (trichloromethyl) sulfone and methylene bisthiocyanate (available as SLIME-TROL RX-38A from Betz Paper Chem Inc.); (11) a non-ionic blend of methylene bisthiocyanate and bromonitrostyrene (available as SLIME-TROL RX-41 from Betz Paper Chem Inc.); (12) a non-ionic blend of 2-(thiocyanomethylthio) benzothiazole (53.2% by weight) and 2-hydroxypropyl methanethiosulfonate (46.8% by weight) (available as BUSAN 25 from Buckman Laboratories Inc.); (13) a non-ionic blend of methylene bis(thiocyanate) 50 percent by weight and 2-(thiocyanomethylthio) benzothiazole 50 percent by weight (available as BUSAN 1009, 1009WB from Buckman Laboratories Inc.); (14) a non-ionic blend of 2-bromo-4'-hydroxyacetophenone (70 percent by weight) and 2-(thiocyanomethylthio) benzothiazole (30 percent by weight) (BUSAN 93, available from Buckman Laboratories Inc.); (15) a non-ionic blend of 5-chloro-2-methyl-4-isothiazoline-3-one (75 percent by weight) and 2-methyl-4-isothiazolin-3-one (25 percent by weight), (available as AMERSTAT 250 from Drew Industrial Division; NALCON 7647, from NALCO Chemical Company; Kathon LY, from Rohm and Haas Co.); and the like, as well as mixtures thereof; (B) anionic biocides, such as (1) anionic potassium N-hydroxymethyl-N-methyl-dithiocarbamate (available as BUSAN 40 from Buckman Larboratories Inc.); (2) an anionic blend of N-hydroxymethyl-N-methyl dithiocarbamate (80% by weight) and sodium 2-mercapto benzothiazole (20% by weight) (available as BUSAN 52 from Buckman Laboratories Inc.); (3) an anionic blend of sodium dimethyl dithiocarbamate 50 percent by weight and (disodium ethylenebis-dithiocarbamate) 50% by weight (available as METASOL 300 from Calgon Corporation; AMERSTAT 272 from Drew Industrial Division; SLIME CONTROL F from Western Chemical Company); (4) an anionic blend of N-methyldithiocarbamate 60 percent by weight and disodium cyanodithioimidocarbonate 40 percent by weight (available as BUSAN 881 from Buckman Laboratories Inc); (5) An anionic blend of methylene bis-thiocyanate (33% by weight), sodium dimethyl-dithiocarbamate (33% by weight), and sodium ethylene bisdithiocarbamate (33% by weight) (available as AMERSTAT 282 from Drew Industrial Division; AMA-131 from Vinings Chemical Company); (6) sodium dichlorophene (G-4-40, available from Givaudan Corp.); and the like, as well as mixtures thereof; (C) cationic biocides, such as (1) cationic poly (oxyethylene (dimethylamino)-ethylene (dimethylamino) ethylene dichloride) (Busan 77, available from Buckman Laboratories Inc.); (2) a cationic blend of methylene bisthiocyanate and dodecyl guanidine hydrochloride (available as SLIME TROL RX-31, RX-32, RX-32P, RX-33, from Betz Paper Chem Inc.); (3) a cationic blend of a sulfone, such as bis(trichloromethyl) sulfone and a quaternary ammonium chloride (available as SLIME TROL RX-36 DPB-865 from Betz Paper Chem. Inc.); (4) a cationic blend of methylene bis thiocyanate and chlorinated phenols (available as SLIME-TROL RX-40 from Betz Paper Chem Inc.); and the like, as well as mixtures thereof. The biocide can be present in any effective amount; typically, the biocide is present in an amount of from about 10 parts per million to about 3 percent by weight of the coating, although the amount can be outside this range.

The coating composition of the present invention can be applied to the substrate by any suitable technique. For example, the layer coatings can be applied by a number of known techniques, including melt extrusion, reverse roll coating, solvent extrusion, and dip coating processes. In dip coating, a web of material to be coated is transported below the surface of the coating material (which generally is dissolved in a solvent) by a single roll in such a manner that the exposed site is saturated, followed by the removal of any excess coating by a blade, bar, or squeeze roll; the process is then repeated with the appropriate coating materials for application of the other layered coatings. With reverse roll coating, the premetered coating material (which generally is dissolved in a solvent) is transferred from a steel applicator roll onto the web material to be coated. The metering roll is stationary or is rotating slowly in the direction opposite to that of the applicator roll. In slot extrusion coating, a flat die is used to apply coating material (which generally is dissolved in a solvent) with the die lips in close proximity to the web of material to be coated. Once the desired amount of coating has been applied to the web, the coating is dried, typically at from about 25° to about 100° C. in an air drier.

Recording sheets of the present invention can be employed in printing and copying processes wherein dry or liquid electrophotographic-type developers are employed, such as electrophotographic processes, ionographic processes, or the like. Yet another embodiment of the present invention is directed to a process for generating images which comprises generating an electrostatic latent image on an imaging member in an imaging apparatus; developing the latent image with a toner; transferring the developed image to a recording sheet of the present invention; and optionally permanently affixing the transferred image to the recording sheet. Still another embodiment of the present invention is directed to an imaging process which comprises generating an electrostatic latent image on a recording sheet of the present invention; developing the latent image with a toner; and optionally permanently affixing the developed image to the recording sheet. Electrophotographic processes are well known, as described in, for example, U.S. Pat. No. 2,297,691 to Chester Carlson. Ionographic and electrographic processes are also well known, and are described in, for example, U.S. Pat. No. 3,564,556, U.S. Pat. No. 3,611,419, U.S. Pat. No. 4,240,084, U.S. Pat. No. 4,569,584, U.S. Pat. No. 2,919,171, U.S. Pat. No. 4,524,371, U.S. Pat. No. 4,619,515, U.S. Pat. No. 4,463,363, U.S. Pat. No. 4,254,424, U.S. Pat. No. 4,538,163, U.S. Pat. No. 4,409,604, U.S. Pat. No. 4,408,214, U.S. Pat. No. 4,365,549, U.S. Pat. No. 4,267,556, U.S. Pat. No. 4,160,257, and U.S. Pat. No. 4,155,093, the disclosures of each of which are totally incorporated herein by reference.

In a particularly preferred embodiment, the present invention is directed to a process for generating images which comprises (1) generating an electrostatic latent image on an imaging member in an imaging apparatus; (2) developing the latent image with a toner which comprises a colorant and a resin selected from the group consisting of (A) copolymers of styrene and at least one other monomer; (B) copolymers of acrylic monomers and at least one other monomer; and (C) mixtures thereof; and (3) transferring the developed image to a recording sheet of the present invention. Optionally, the transferred image may be permanently affixed to the recording sheet. It is preferred that the toner resin be a polymer containing the same monomer or monomers as the binder polymer of the recording sheet.

Examples of suitable toner resins for the process of the present invention include styrene-butadiene copolymers, such as those containing about 85 percent by weight styrene monomers and prepared as disclosed in U.S. Pat. No. 4,558,108, the disclosure of which is totally incorporated herein by reference, styrene-butadiene copolymers containing from about 5 to about 50 percent by weight styrene monomers and available as #199, #200, #201, #451, and #057 from Scientific Polymer Products, and the like; styrene-isoprene copolymers, such as those with a styrene content of 50 percent by weight or more and prepared via living anionic polymerization techniques as disclosed by S. Malhotra et al. in *J. Macrornol. Science - Chem.* A(20)7, page 733, the disclosure of which is totally incorporated herein by reference, and the like; styrene-alkyl methacrylate copolymers, wherein alkyl is methyl, ethyl, isopropyl, butyl, hexyl, isodecyl, dodecyl, hexadecyl, octadecyl, or the like, such as those prepared via ultrasonic polymerization as described by S. Malhotra et al. in *J. Macromol. Science - Chem.* A18(5), page 783, the disclosure of which is totally incorporated herein by reference, or the like; styrene-aryl methacrylate copolymers, wherein aryl is phenyl, benzyl, or the like, such as those prepared via ultrasonic polymerization as described by S. Malhotra et al. in *J. Macrornol. Science - Chem.* A18(5), page 783, or the like; styrene-butylmethacrylate copolymers, such as #595, available from Scientific Polymer Products, or the like; styrene-allyl alcohol copolymers, such as #393 and #394, available from Scientific Polymer Products, or the like; styrene-maleic anhydride copolymers, such as those containing from about 50 to about 75 percent by weight styrene monomers, including #456, #049, #457, and #458, available from Scientific Polymer Products, or the like; and the like, as well as mixtures thereof. Particularly preferred are styrene-butadiene copolymers and styrene-butyl methacrylate copolymers with a styrene content (by weight) of at least 85 percent. In a preferred embodiment, the toner resin contains the same monomers present in the polymeric binder of the recording sheet. The resin is present in the toner in any effective amount, typically from about 10 to 95 percent by weight, preferably from about 20 to about 90 percent by weight, and more preferably from about 50 to about 70 percent by weight, although the amount can be outside these ranges.

Optionally, if it is desired to generate images that are visible with the naked eye, the toner composition can also contain a colorant. Typically, the colorant material is a pigment, although dyes can also be employed. Examples of suitable pigments and dyes are disclosed in, for example, U.S. Pat. No. 4,788,123, U.S. Pat. No. 4,828,956, U.S. Pat. No. 4,894,308, U.S. Pat. No. 4,948,686, U.S. Pat. No. 4,963,455, and U.S. Pat. No. 4,965,158, the disclosures of each of which are totally incorporated herein by reference. Specific examples of suitable dyes and pigments include carbon black, nigrosine dye, aniline blue, magnetites, and mixtures thereof, with carbon black being the most common colorant. The pigment should be present in an amount sufficient to render the toner composition highly colored to permit the formation of a clearly visible image on a recording member. Typically, the pigment particles are present in amounts of from about 1 percent by weight to about 20 percent by weight based on the total weight of the toner composition, although the amount can be outside this range.

When the pigment particles are magnetites, which comprise a mixture of iron oxides ($Fe_3O_4$) such as those commercially available as Mapico Black, these pigments are present in the toner composition in any effective amount, typically from about 10 percent by weight to about 70 percent by weight, and preferably from about 20 percent by weight to about 50 percent by weight, although the amount can be outside these ranges.

Colored toner pigments are also suitable, including red, green, blue, brown, magenta, cyan, and yellow particles, as well as mixtures thereof, wherein the colored pigments are present in amounts that enable the desired color. Illustrative examples of suitable magenta pigments include 2,9-dimethyl-substituted quinacridone and anthraquinone dye, identified in the color index as CI 60710, CI Dispersed Red 15, a diazo dye identified in the color index as CI 26050, CI Solvent Red 19, and the like. Illustrative examples of suitable cyan pigments include copper tetra-4(octadecyl sulfonamido) phthalocyanine, copper phthalocyanine pigment, listed in the color index as CI 74160, Pigment Blue, and Anthradanthrene Blue, identified in the color index as CI 69810, Special Blue X-2137, and the like. Illustrative examples of yellow pigments that may be selected include diarylide yellow 3,3-dichlorobenzidene acetoacetanilides, a monoazo pigment identified in the color index as CI 12700, CI Solvent Yellow 16, a nitrophenyl amine sulfonamide identified in the color index as Foron Yellow SE/GLN, CI Dispersed Yellow 33, 2,5-dimethoxy-4-sulfonanilide phenylazo-4'-chloro-2,5-dimethoxy aceto-acetanilide, Permanent Yellow FGL, and the like. Other suitable toner colorants include Normandy Magenta RD-2400 (Paul Uhlich), Paliogen Violet 5100 (BASF), Paliogen Violet 5890 (BASF), Permanent Violet VT2645 (Paul Uhlich), Heliogen Green L8730 (BASF), Argyle Green XP-111-S (Paul Uhlich), Brilliant Green Toner GR 0991 (Paul Uhlich), Heliogen Blue L6900, L7020 (BASF), Heliogen Blue D6840, D7080 (BASF), Sudan Blue OS (BASF), PV Fast Blue B2G01 (American Hoechst), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Novoperm Yellow FG 1 (Hoechst), Permanent Yellow YE 0305 (Paul Uhlich), Lumogen Yellow D0790 (BASF), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Tolidine Red (Aldrich), Scarlet for Thermoplast NSD PS PA (Ugine Kuhlmann of Canada), E. D. Toluidine Red (Aldrich), Lithol Rubine Toner (Paul Uhlich), Lithol Scarlet 4440 (BASF), Bon Red C (Dominion Color Co.), Royal Brilliant Red RD-8192 (Paul Uhlich), Oracet Pink RF (Ciba-Geigy), Paliogen Red 3871K (BASF), Paliogen Red 3340 (BASF), and Lithol Fast Scarlet L4300 (BASF). Color pigments are typically present in the toner an amount of from about 15 to about 20.5 percent by weight, although the amount can be outside this range.

The toner compositions of the present invention can also contain an optional charge control additive. Examples of suitable charge control agents are disclosed in U.S. Pat. No. 4,788,123, U.S. Pat. No. 4,828,956, U.S. Pat. No. 4,894,308, U.S. Pat. No. 4,948,686, U.S. Pat. No. 4,963,455, and U.S. Pat. No. 4,965,158, the disclosures of each of which are totally incorporated herein by reference. Specific examples of suitable charge control agents include alkyl pyridinium halides, such as cetyl pyridinium chloride, as disclosed in U.S. Pat. No. 4,298,672, the disclosure of which is totally incorporated herein by reference, cetyl pyridinium tetrafluoroborates, quaternary ammonium sulfate and sulfonate compounds, such as distearyl dimethyl ammonium methyl sulfate, as disclosed in U.S. Pat. No. 4,338,390, the disclosure of which is totally incorporated herein by reference, stearyl phenethyl dimethyl ammonium tosylates, as disclosed in U.S. Pat. No. 4,338,390, distearyl dimethyl ammonium methyl sulfate, as disclosed in U.S. Pat. No. 4,560,635, the disclosure of which is totally incorporated herein by reference, distearyl dimethyl ammonium bisulfate as disclosed in U.S. Pat. No. 4,937,157 and U.S. Pat. No. 4,560,635, the disclosures of each of which are totally incorporated herein by reference, stearyl dimethyl hydrogen ammonium tosylate, charge control agents as disclosed in U.S. Pat. No. 4,294,904, the disclosure of which is totally incorporated herein by reference, zinc 3,5-di-tert-butyl salicylate compounds, such as Bontron E-84, available from Orient Chemical Company of Japan, or zinc compounds as disclosed in U.S. Pat. No. 4,656,112, the disclosure of which is totally incorporated herein by reference, aluminum 3,5-di-tert-butyl salicylate compounds, such as Bontron E-88, available from Orient Chemical Company of Japan, or aluminum compounds as disclosed in U.S. Pat. No. 4,845,003, the disclosure of which is totally incorporated herein by reference, and the like, as well as mixtures thereof and/or any other charge control agent suitable for dry electrophotographic toners. Additional examples of suitable charge control additives are disclosed in U.S. Pat. No. 4,560,635 and U.S. Pat. No. 4,294,904, the disclosures of each of which are totally incorporated herein by reference. Charge control agents are present in any effective amount, typically from about 0.1 to about 4 percent by weight, and more preferably from about 0.5 to about 1 percent by weight, although the amount can be outside this range.

The toner compositions can be prepared by any suitable method. For example, the components of the dry toner particles can be mixed in a ball mill, to which steel beads for agitation are added in an amount of approximately five times the weight of the toner. The ball mill can be operated at about 120 feet per minute for about 30 minutes, after which time the steel beads are removed. Dry toner particles for two-component developers generally have an average particle size of from about 6 to about 20 microns.

Another method, known as spray drying, entails dissolving the appropriate polymer or resin in an organic solvent such as toluene or chloroform, or a suitable solvent mixture. The toner colorant is also added to the solvent. Vigorous agitation, such as that obtained by ball milling processes, assists in assuring good dispersion of the colorant. The solution is then pumped through an atomizing nozzle while using an inert gas, such as nitrogen, as the atomizing agent. The solvent evaporates during atomization, resulting in toner particles of a colored resin, which are then attrited and classified by particle size. Particle diameter of the resulting toner varies, depending on the size of the nozzle, and generally varies between about 0.1 and about 100 microns.

Another suitable process is known as the Banbury method, a batch process wherein the dry toner ingredients are pre-blended and added to a Banbury mixer and mixed, at which point melting of the materials occurs from the heat energy generated by the mixing process. The mixture is then dropped into heated rollers and forced through a nip, which results in further shear mixing to form a large thin sheet of the toner material. This material is then reduced to pellet form and further reduced in size by grinding or jetting, after which the particles are classified by size.

Another suitable toner preparation process, extrusion, is a continuous process that entails dry blending the toner ingredients, placing them into an extruder, melting and mixing the mixture, extruding the material, and reducing the extruded material to pellet form. The pellets are further reduced in size by grinding or jetting, and are then classified by particle size.

Other similar blending methods may also be used. Subsequent to size classification of the toner particles, any external additives are blended with the toner particles. If desired, the resulting toner composition is then mixed with carrier particles.

Any suitable external additives can also be utilized with the dry toner particles. The amounts of external additives are measured in terms of percentage by weight of the toner composition, but are not themselves included when calculating the percentage composition of the toner. For example, a toner composition containing a resin, a colorant, and an external additive can comprise 80 percent by weight resin and 20 percent by weight colorant; the amount of external additive present is reported in terms of its percent by weight of the combined resin and colorant. External additives can include any additives suitable for use in electrostatographic toners, including straight silica, colloidal silica (e.g. Aerosil R972®, available from Degussa, Inc.), ferric oxide, Unilin (a linear polymeric alcohol comprising a fully saturated hydrocarbon backbone with at least about 80 percent of the polymeric chains terminated at one chain end with a hydroxyl group, of the general formula $CH_3(CH_2)_nCH_2OH$, wherein n is a number from about 30 to about 300, and preferably from about 30 to about 50, available from Petrolite Chemical Company), polyethylene waxes, polypropylene waxes, polymethylmethacrylate, zinc stearate, chromium oxide, aluminum oxide, stearic acid, polyvinylidene fluoride (e.g. Kynar®, available from Pennwalt Chemicals Corporation), and the like. External additives can be present in any desired or effective amount.

Dry toners can be employed alone in single component development processes, or they can be employed in combination with carrier particles in two component development processes. Any suitable carrier particles can be employed with the toner particles. Typical carrier particles include granular zircon, steel, nickel, iron ferrites, and the like. Other typical carrier particles include nickel berry carriers as disclosed in U.S. Pat. No. 3,847,604, the entire disclosure of which is incorporated herein by reference. These carriers comprise nodular carrier beads of nickel characterized by surfaces of reoccurring recesses and protrusions that provide the particles with a relatively large external area. The diameters of the carrier particles can vary, but are generally from about 50 microns to about 1,000 microns, thus allowing the particles to possess sufficient density and inertia to avoid adherence to the electrostatic images during the development process.

Carrier particles can possess coated surfaces. Typical coating materials include polymers and terpolymers, including, for example, fluoropolymers such as polyvinylidene fluorides as disclosed in U.S. Pat. No. 3,526,533, U.S. Pat. No. 3,849,186, and U.S. Pat. No. 3,942,979, the disclosures of each of which are totally incorporated herein by reference. Coating of the carrier particles may be by any suitable process, such as powder coating, wherein a dry powder of the coating material is applied to the surface of the carrier particle and fused to the core by means of heat, solution coating, wherein the coating material is dissolved in a solvent and the resulting solution is applied to the carrier surface by tumbling, or fluid bed coating, in which the carrier particles are blown into the air by means of an air stream, and an atomized solution comprising the coating material and a solvent is sprayed onto the airborne carrier particles repeatedly until the desired coating weight is achieved. Carrier coatings may be of any desired thickness or coating weight. Typically, the carrier coating is present in an amount of from about 0.1 to about 1 percent by weight of the uncoated carrier particle, although the coating weight may be outside this range.

The toner is present in the two-component developer in any effective amount, typically from about 1 to about 5 percent by weight of the carrier, and preferably about 3 percent by weight of the carrier, although the amount can be outside these ranges.

Any suitable conventional electrophotographic development technique can be utilized to deposit toner particles of the present invention on an electrostatic latent image on an imaging member. Well known electrophotographic development techniques include magnetic brush development, cascade development, powder cloud development, electrophoretic development, and the like. Magnetic brush development is more fully described, for example, in U.S. Pat. No. 2,791,949, the disclosure of which is totally incorporated herein by reference; cascade development is more fully described, for example, in U.S. Pat. No. 2,618,551 and U.S. Pat. No. 2,618,552, the disclosures of each of which are totally incorporated herein by reference; powder cloud development is more fully described, for example, in U.S. Pat. No. 2,725,305, U.S. Pat. No. 2,918,910, and U.S. Pat. No. 3,015,305, the disclosures of each of which are totally incorporated herein by reference; and liquid development is more fully described, for example, in U.S. Pat. No. 3,084,043, the disclosure of which is totally incorporated herein by reference.

The deposited toner image can be transferred to the recording sheet by any suitable technique conventionally used in electrophotography, such as corona transfer, pressure transfer, adhesive transfer, bias roll transfer, and the like. Typical corona transfer entails contacting the deposited toner particles with a sheet of paper and applying an electrostatic charge on the side of the sheet opposite to the toner particles. A single wire corotron having applied thereto a potential of between about 5000 and about 8000 volts provides satisfactory electrostatic charge for transfer.

After transfer, the transferred toner image can be fixed to the recording sheet. The fixing step can be also identical to that conventionally used in electrophotographic imaging. Typical, well known electrophotographic fusing techniques include heated roll fusing, flash fusing, oven fusing, laminating, adhesive spray fixing, and the like.

The recording sheets of the present invention can also be used in any other printing or imaging process, such as printing with pen plotters, handwriting with ink pens, offset printing processes, or the like, provided that the ink employed to form the image is compatible with the ink receiving layer of the recording sheet.

Specific embodiments of the invention will now be described in detail. These examples are intended to be illustrative, and the invention is not limited to the materials, conditions, or process parameters set forth in these embodiments. All parts and percentages are by weight unless otherwise indicated.

EXAMPLE I

Transparency sheets were prepared by a dip coating process (both sides coated in one operation) by providing Mylar® sheets (8.5×11 inches) in a thickness of 100 microns and coating them with blends of a binder resin, an additive, an antistatic agent, and a traction agent. The coated Mylar® sheets were then dried in a vacuum hood for one hour. Measuring the difference in weight prior to and subsequent to coating these sheets indicated an average coating weight of about 300 milligrams on each side in a thickness of about 3 microns.

These sheets were fed into a Xerox ® 1038 copier and black images were obtained with optical densities of about 1.3. The images could not be lifted off with Scotch ® tape (3M).

The recording sheet coating compositions were as follows:

1: Styrene-butadiene copolymer (styrene content about 85 percent by weight), 78 percent by weight, prepared as disclosed in U.S. Pat. No. 4,558,108 (Alexandru et al.), the disclosure of which is totally incorporated herein by reference; diphenylmethane (Aldrich D20,931-7), 20 percent by weight; choline chloride (Aldrich 23,994-1), 1 percent by weight; colloidal silica, Syloid 74, obtained from W. R. Grace & Co., 1 percent by weight. Solids present in toluene solution in a concentration of 5 percent by weight.

2: Styrene-butadiene copolymer (styrene content about 85 percent by weight), 78 percent by weight; 3,4-dimethoxy benzaldehyde (Aldrich 14,375-8), 20 percent by weight; choline iodide (Aldrich C7,971-9), 1 percent by weight; colloidal silica, 1 percent by weight. Solids present in toluene solution in a concentration of 5 percent by weight.

3: Styrene-butadiene copolymer (styrene content about 85 percent by weight), 78 percent by weight; Indan (Aldrich 1-180-4), 20 percent by weight; butyryl choline chloride (Aldrich 85,537-5), 1 percent by weight; colloidal silica, 1 percent by weight. Solids present in toluene solution in a concentration of 5 percent by weight.

4: Styrene-butylmethacrylate resin (styrene content about 85 percent by weight), 78 percent by weight; 1,3,5-trimethoxy benzene (Aldrich 13,882-7), 20 percent by weight; butyryl choline chloride, 1 percent by weight; colloidal silica, 1 percent by weight. Solids present in toluene solution in a concentration of 5 percent by weight.

5: Styrene-allyl alcohol copolymer (hydroxyl content 7.3 to 8 percent by weight) (Scientific Polymer Products #394), 78 percent by weight; 2-methylbenzyl alcohol (Aldrich 18,847-6), 20 percent by weight; choline chloride (Aldrich 23,994-1), 1 percent by weight; colloidol silica, 1 percent by weight. Solids present in tetrahydrofuran solution in a concentration of 5 percent by weight.

6: Styrene-maleic anhydride copolymer (styrene content 50 percent by weight) (Scientific Polymer Products #456), 78 percent by weight; tripropanolamine (Aldrich 25,474-6), 20 percent by weight; choline chloride (Aldrich 23,994-1), 1 percent by weight; colloidal silica, 1 percent by weight. Solids present in acetone solution in a concentration of 5 percent by weight.

7: None (Untreated).

8: Styrene-maleic anhydride copolymer (styrene content 50 percent by weight) (Scientific Polymer Products #049), 100 percent by weight. Solids present in ethanol solution in a concentration of 5 percent by weight.

9: Styrene-maleic anhydride (styrene content 50 percent by weight) (Scientific Polymer Products #049), 80 percent by weight; benzyl alcohol (Aldrich 30,519-7), 18 percent by weight; choline chloride (Aldrich 23,994), 2 percent by weight. Solids present in ethanol solution in a concentration of 5 percent by weight.

The optical densities of the images before and after the tape test were as follows:

| # | Substrate | Optical Density | | |
|---|---|---|---|---|
| | | Before | After | % TF |
| 1 | Mylar ® | 1.35 | 1.35 | 100 |
| 2 | Mylar ® | 1.33 | 1.33 | 100 |
| 3 | Mylar ® | 1.30 | 1.30 | 100 |
| 4 | Mylar ® | 1.25 | 1.25 | 100 |
| 5 | Mylar ® | 1.25 | 1.20 | 96 |
| 6 | Mylar ® | 1.25 | 1.15 | 92 |
| 7 | 4024 ® paper | 1.25 | 0.87 | 70 |
| 8 | 4024 ® paper | 1.25 | 1.00 | 80 |
| 9 | 4024 ® paper | 1.30 | 1.20 | 92 |

As the results indicate, the transparent recording sheets coated with the blends of binder and additive exhibited toner fix of from 92 percent to 100 percent. The untreated paper sheet exhibited a toner fix of 70 percent, which improved to from 80 to 92 percent when treated with a blend of binder and additive.

Other embodiments and modifications of the present invention may occur to those skilled in the art subsequent to a review of the information presented herein; these embodiments and modifications, as well as equivalents thereof, are also included within the scope of this invention.

What is claimed is:

1. A recording sheet which comprises (a) a substrate; (b) a coating on the substrate which comprises (i) a binder selected from the group consisting of (A) copolymers of styrene and at least one other monomer; (B) copolymers of acrylic monomers and at least one other monomer; and (C) mixtures thereof; and (ii) an additive having a melting point of less than about 65° C. and a boiling point of more than about 150° C. and selected from the group consisting of indan compounds; (c) an optional filler; (d) an optional antistatic agent; and (e) an optional biocide.

2. A recording sheet according to claim 1 wherein the binder and the additive material are present in relative amounts of from about 10 percent by weight binder and about 90 percent by weight additive material to about 99 percent by weight binder and about 1 percent by weight additive material.

3. A recording sheet according to claim 1 also containing a quaternary acrylic copolymer latex antistatic agent.

4. A recording sheet according to claim 1 wherein the binder is a copolymer of styrene and at least one other monomer.

5. A recording sheet according to claim 1 wherein the binder is a copolymer containing acrylic monomers and at least one other monomer.

6. A recording sheet according to claim 1 wherein the binder is selected from the group consisting of styrene-butadiene copolymers, styrene-isoprene copolymers, styrene-alkyl methacrylate copolymers, styrene-aryl methacrylate copolymers, styrene-allyl alcohol copolymers, styrene-maleic anhydride copolymers, and mixtures thereof.

7. A recording sheet according to claim 1 also containing an antistatic agent selected from the group consisting of (1) choline halides; (2) acetyl choline halides; (3) acetyl-$\beta$-methyl choline halides; (4) benzoyl choline halides; (5) carbamyl choline halides; (6) carnitinamide hydroxides; (7) carnitine hydrohalides; (8) (2-bromo ethyl) trimethyl ammonium halides; (9) (2-chloro ethyl)

trimethyl ammonium halides; (10) (3-carboxy propyl) trimethyl ammonium halides; (11) butyryl choline halides; (12) butyryl thiocholine halides; (13) S-propionyl thiocholine halides; (14) S-acetylthiocholine halides; (15) suberyl dicholine dihalides; and mixtures thereof.

8. A recording sheet which comprises (a) a substrate; (b) a coating on the substrate which comprises (i) a binder selected from the group consisting of (A) copolymers of styrene and at least one other monomer; (B) copolymers of acrylic monomers and at least one other monomer; and (C) mixtures thereof; and (ii) an additive having a melting point of less than about 65° C. and a boiling point of more than about 150° C. and selected from the group consisting of (1) indan; (2) indene; (3) 1-indanone; (4) 2-indanone; (5) 1-indanol; (6) 2-indanol; (7) 5-indanol; (8) 5-methoxy indan; and mixtures thereof; (c) an optional filler; (d) an optional antistatic agent; and (e) an optional biocide.

* * * * *